United States Patent [19]

Yamagishi et al.

[11] Patent Number: 4,848,031

[45] Date of Patent: Jul. 18, 1989

[54] DOOR CONTROL DEVICE

[75] Inventors: Jun Yamagishi; Hiromitsu Nishikawa, both of Yokohama; Toshio Yokoo, Atsugi, all of Japan

[73] Assignees: Nissan Motor Co., Ltd.; Ohi Seisakusho Co., Ltd., both of Yokohama, Japan

[21] Appl. No.: 251,178

[22] Filed: Sep. 30, 1988

[30] Foreign Application Priority Data

Oct. 8, 1987 [JP] Japan ..... 62-254444

[51] Int. Cl.[4] ..... E05F 15/00

[52] U.S. Cl. ..... 49/280; 49/324; 49/356; 49/358; 49/394

[58] Field of Search ..... 49/394, 356, 357, 324, 49/280, 358

[56] References Cited

U.S. PATENT DOCUMENTS 4,530,185 7/1985 Moriya et al. ..... 49/280
4,644,693 2/1987 Wang ..... 49/280

FOREIGN PATENT DOCUMENTS 58-178779 10/1983 Japan .
62-101782 5/1987 Japan .

*Primary Examiner*—Philip C. Kannan
*Attorney, Agent, or Firm*—Foley & Lardner, Schwartz, Jeffery, Schwaab, Mack, Blumenthal & Evans

[57] ABSTRACT

A door control device is disclosed, which comprises a full closing lock device mounted to the door and latchingly restraining the door to the vehicle body when the door is pivoted to its fully closed position; a lock cancelling operation switch mounted on the door at a position to be manipulatable from the outside of the vehicle body; a full closing lock cancelling device mounted on the door and cancelling a locked condition of the full closing lock device upon operation of the lock cancelling operation switch; a door driving device arranged between the door and the vehicle body, the door driving device driving the door to a predetermined half-open position upon cancellation of the locked condition of the full closing lock device; a half opening lock device mounted on the door and latchingly restraining the door to the vehicle body when the door is pivoted to the half-open position; and a half opening lock cancelling device mounted on the door for cancelling a locked condition of the half opening lock device.

11 Claims, 6 Drawing Sheets

DOOR CONTROL DEVICE

BACKGROUND OF THE INVENTION

1. Field of the Invention

The present invention relates in general to a door control device for use in a motor vehicle, and more particularly to a door control device which, upon requirement, can automatically open the door to a slight open position and thereafter allow the same to be opened further by manual labor.

2. Description of the Prior Art

Hitherto, for facilitation of door manipulation, various automatic door control devices have been proposed and put into practical use particularly in the field of motor vehicles. One of them is disclosed in Japanese Patent First Provisional Publication No. 58-178779, wherein by manipulating an outdoor or indoor switch, cancellation of the door lock and the opening and closing of the door are automatically carried out by drive means such as electric motor or the like. The other device is disclosed in Japanese Patent First Provisional Publication No. 62-101782, wherein by manipulating an outdoor or indoor switch, cancellation of the door lock is achieved by an electric motor.

However, due to the inherent constructions, the devices as mentioned hereinabove have the following drawbacks.

That is, in the device of '779 publication, entire construction thereof is bulky and heavy. Furthermore, due to employment of the mechanism for carrying out both the automatic movement of the door and the manual movement of the same the device becomes complicated in construction.

In the device of '782 publication, when, with the motor vehicle standing on an inclined ground, the lock cancellation is effected carelessly, the door thus unlocked is suddenly opened to its full-open position by its own weight. This tends to cause breakage of the door and in a severe case wound on a person standing by the vehicle. This dangerous sudden opening of the door is also caused by a considerable wind blowing against the door unlocked. The sudden door opening by the wind may occur also in the device of '779 publication because the movement of the door includes a range within which the door is swung by manual labor.

SUMMARY OF THE INVENTION

It is therefore an object of the present invention to provide a door control device which is free of the above-mentioned drawbacks.

According to the present invention, there is provided a door control device which, upon requirement, can automatically open the door to a predetermined slight open position and thereafter allow the same to be opened further by manual labor.

According to the present invention, there is provided a door control device for controlling the movement of a door relative to a vehicle body, the door control device comprising a full closing lock device mounted to the door and latchingly restraining the door to the vehicle body when the door is pivoted to its fully closed position; a lock cancelling operation switch mounted on the door at a position to be manipulatable from the outside of the vehicle body; a full closing lock cancelling device mounted on the door and cancelling a locked condition of the full closing lock device upon operation of the lock cancelling operation switch; a door driving device arranged between the door and the vehicle body, the door driving device driving the door to a predetermined half-open position upon cancellation of the locked condition of the full closing lock device; a half opening lock device mounted on the door and latchingly restraining the door to the vehicle body when the door is pivoted to the half-open position; and a half opening lock cancelling device mounted on the door for cancelling a locked condition of the half opening lock device.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, an embodiment of the present invention will be described with reference to the accompanying drawings.

Figure 2:
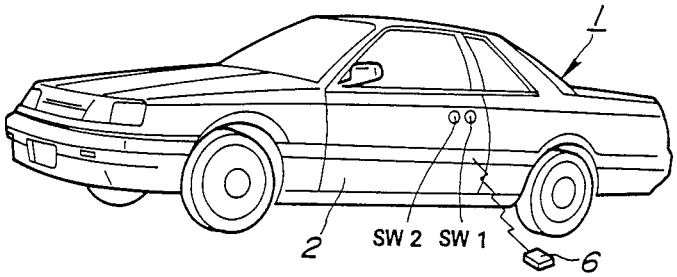
FIG. 2 is an illustration of a motor vehicle equipped with the door of FIG. 1.

Throughout the description, the terms regarding the direction in which parts are oriented, such as "front", "forward", "upper", "upward", "forward" and the like are to be understood with respect to the closed condition of the door 2 as shown in FIG. 2.

Figure 1:
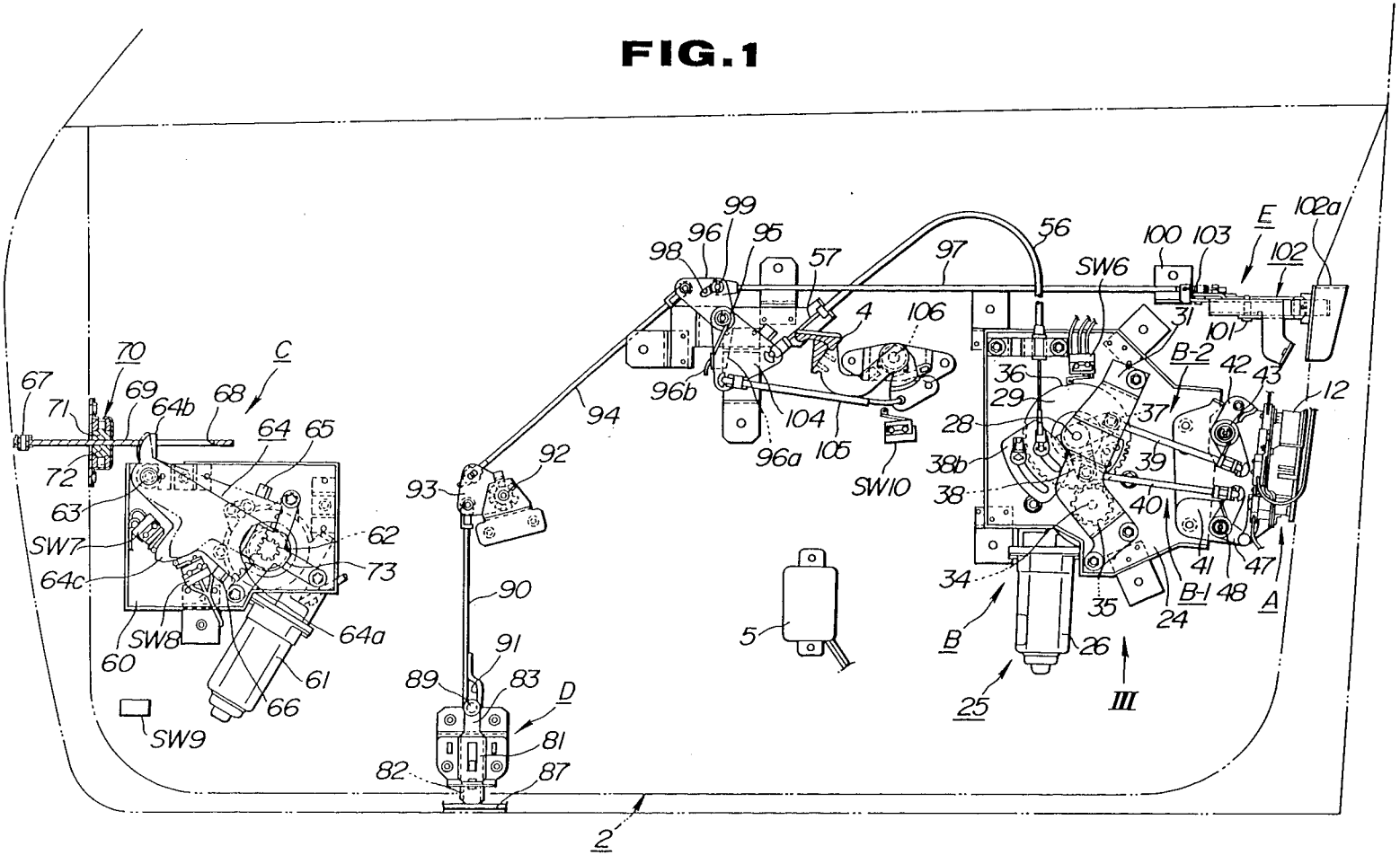
FIG. 1 is a side view of a door control device of the present invention, which is installed in an automotive door.

Referring to Figs. 1 and 2 of the drawings, there is shown a layout of various parts arranged on an automotive door. That is, designated by numeral 1 is a body of a motor vehicle, 2 is a door having a front end hinted to the vehicle body 1, reference "A" is a full closing lock device which, upon closing of the door 2, engages with a part of the door 2 to latch the door in the fully closed position, and reference "B" is a lock cancelling and latch driving device which is located in the vicinity of the full closing lock device "A". The device "B" is controlled by both a lock cancelling operation switch "SW1" mounted on an outboard side of the door 2 and a half-latch detecting switch "SW3" (see FIG. 4) mounted in the full closing lock device "A".

More specifically, the device "B" comprises a full closing lock cancelling device "B-1" which, upon manipulation of the switch "SW1", cancels a locked condition of the full closing lock device "A", and a latch driving device "B-2" which forcedly drives an aftermentioned latch 14 of the device "A" to its full-latch position upon receiving from the half-latch, detecting switch SW3 a door closed information signal which is issued when the latch 14 is within a given range between its free position and its half-latch position. Both devices "B-1" and "B-2" are driven by a single reversable electric motor 26.

Designated by reference "C" is a door driving device whose most parts are mounted in the door 2, but some parts of which are incorporated with the vehicle body 1. That is, when the locked condition of the full closing lock device "A" is cancelled, the door driving device "C" drives the door 2 to a predetermined slight open position (see FIG. 11) wherein a small clearance is defined between the door 2 and the vehicle body 1. Preferably, the clearance has such a size as to allow putting a human hand thereinto.

Designated by reference "D" is a half opening lock device which is installed in the door 2. When the door 2 is driven to the slight open position, the half opening lock device "D" latches the door in the the position by bringing a part thereof into latched engagement with the vehicle body 1. Designated by reference "E" is an half opening lock cancelling device which is installed in the door 2. The lock cancelling device "E" functions to cancel a locked condition of the half opening lock device "D"

Desingated by numeral 4 is an inside handle which is pivotally mounted on an inboard side of the door 2. Although not shown in the drawings, a return spring is connected to the inside handle 4 to bias the same toward its rest position. The inside handle 4 functions to cancel the locked conditions of the full closing lock device "A" and the half opening lock device "D".

Designated by numeral 5 is a locking and unlocking control device which is installed in the door 2. The device 5 functions to electrically control the locking and unlocking operation of the full closing lock device "A". When a transmitter 6 issuing a given electric wave is brought near the door 2 from the outside of the vehicle, a receiver (not shown) installed in the door 2 catches the electric wave. During the time for which the receiver is receiving the wave, a manipulation of a locking and unlocking switch "SW2" positioned near the lock cancelling operation switch "SW1" induces locked or unlocked condition of the full closing lock device "A" alternately. Furthermore, during the time, the condition of the full closing lock device "A" can be switched by manipulating a locking and unlocking switch and a control knob (both not shown) installed in a vehicle cabin. When the locking and unlocking control device 5 is in the locking condition, the lock cancelling operation of the full closing lock device "A" by the locking cancelling operation switch "SW1" is disabled, that is, the electric motor 26 is suppressed from being energized. While, when the device 5 turns to assume the unlocking condition, the lock cancelling operation of the full closing lock device "A" becomes permitted thereby making energization of the electric motor 26 possible.

In place of the above-mentioned transmitter 6, a known key-less entry system may be employed. That is, in this system, the locking and unlocking of the door is achieved at only the time when a person handling the door is recognized as a proper person who is permitted to use the vehicle. As the key-less entry system, a key board system, a magnetic card system and an infrared ray generator system have been hitherto put into practical use.

In the following, each part will be described in detail.

The full closing lock device "A" and the lock cancelling and latch driving device "B" are substantially the same as those disclosed in the afore-mentioned Japanese Publication No. 62-101782.

As is seen from FIGS. 3 to 7, the full closing lock device "A" comprises a case 12 in which a forked-latch 14 is pivotally installed through a shaft 15. Upon closing of the door, the latch 14 is brought into latching engagement with a striker 13 which is secured to, for example, a pillar of the vehicle body 1.

Figure 5:
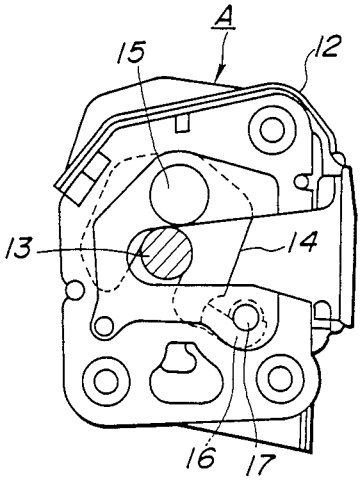
FIG. 5 is a back view of the full closing lock device in a full-latch condition.
Figure 6:
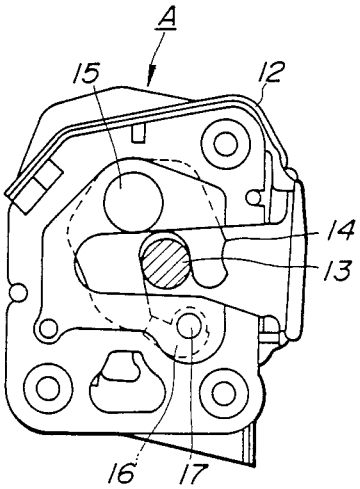
FIG. 6 is a view similar to FIG. 5, but showing a half-latch condition of the full closing lock device.
Figure 7:
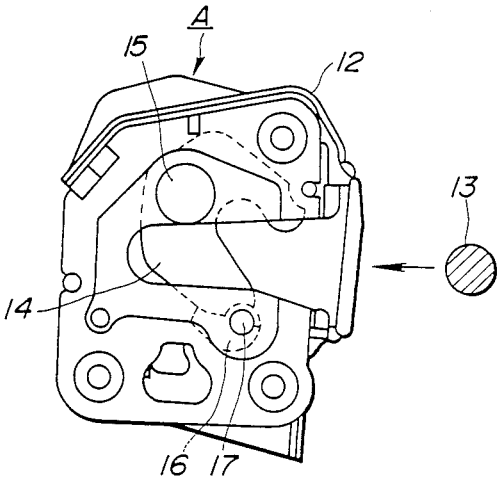
FIG. 7 as a view also similar to FIG. 5, but showing an open or free condition wherein a door is released therefrom.

The latch 14 can assume three specified positions which are an open or free position as shown in FIG. 7 wherein the latch 14 completely disengages the striker 13 and is thus ready for engagement with the same, a full-latch position as shown in FIG. 5 wherein the latch 14 completely engages the striker 13, and a half-latch position as shown in FIG. 6 wherein the latch 14 halfly engages the striker 13 at a position between the open and full-latch positions. Although not shown in the drawings, a biasing spring is employed for biasing the latch 14 in a counterclockwise direction in FIGS. 5 to 7.

Figure 4:
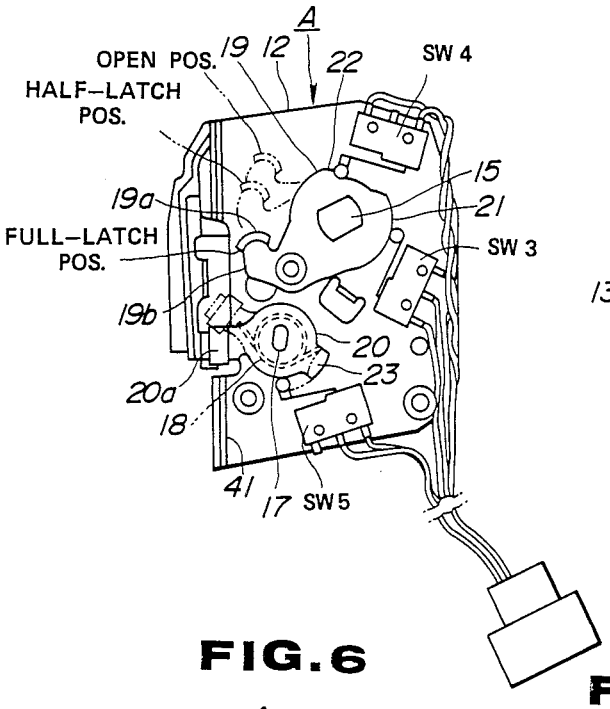
FIG. 4 is a front view of a full closing lock device with some parts removed.

Within the case 12, there is further installed a crescent-shaped pawl 16 which is pivotally connected to the case through a shaft 17 which is parallel with the aforementioned shaft 15 of the latch 14. When the latch 14 is in the half-latch position or the full-latch position, the pawl 16 engages a given portion of the latch 14 thereby to suppress a further pivotal movement of the latch 14 toward the open position. By the work of a spring 18 as shown in FIG. 4, the pawl 16 is biased in a clockwise direction in FIGS. 5 to 7 (that is, in a counterclockwise direction in FIG. 4). Usually, the pawl 16 assume the position as shown in FIGS. 5 to 7. However, when, against the force of the spring 18, the pawl 16 is pivoted in a counterclockwise direction in FIGS. 5 to 7 (that is, in an unlatching direction), the engagement with the latch 14 becomes cancelled thereby permitting the door to open freely.

The shaft 15 of the latch 14 and the shaft 17 of the pawl 16 pierce the case 12 and project forward. The forwardly projected ends of the shafts 15 and 17 are respectively equipped with a rotating plate 19 and an open lever 20. Thus, the latch 14 and the rotating plate 19 rotate together, and the pawl 16 and the open lever 20 rotate together.

As is seen from FIG. 4, the rotating plate 19 is formed with an arm portion **19*b*, a first cam surface 21 and a second cam surface 22. The arm portion 19*b* has at its leading end an engaging portion 19*a***.

The first cam surface 21 is so shaped and arranged as to keep the half-latch detecting switch "SW3" (microswitch) "on" during the time for which the latch 14 is being pivoted from the half-latch position to the full-latch position. The pivoting movement of the latch 14 is caused by the striker 13 on the door 2 under closing movement of the door 2.

The second cam surface 22 is so shaped and arranged as to operate a full-latch detecting switch "SW4" (microswitch) "on" when the latch 14 comes to the full-latch position.

As is seen from FIG. 4, the open lever 20 is formed with an arm portion 20*a* and a cam surface 23.

The cam surface 23 is so shaped and arranged as to operate a latch cancelling detecting switch "SW5" "on" when the pawl 16 is turned to a position where the pivoting movement of the latch 14 is not blocked.

Figure 3:
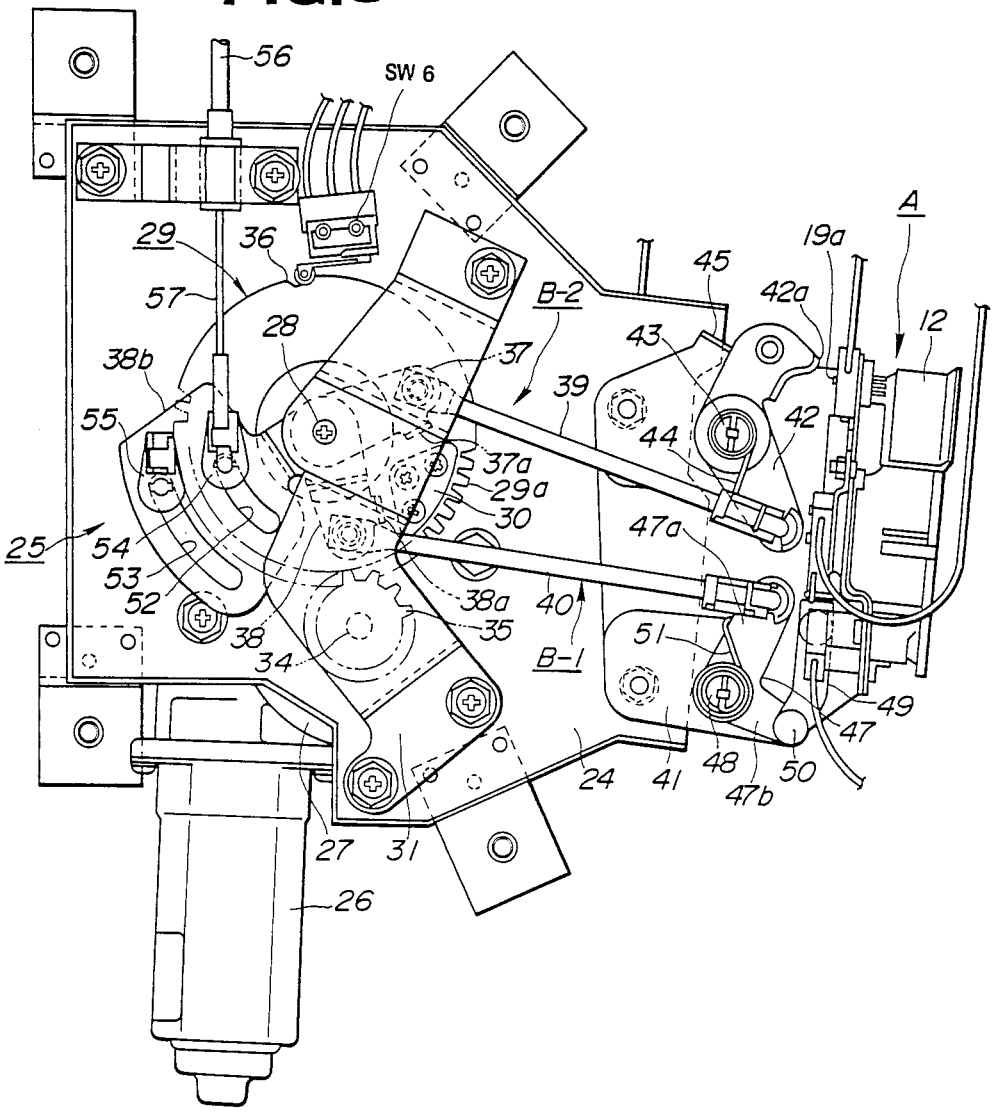
FIG. 3 is an enlarged view of the part indicated by the arrow "III" of FIG. 1.

As is shown in FIGS. 1 and 3, to a front portion of the full closing lock device "A", there is connected a supporting plate 24 on which an electric actuator 25 is mounted.

The electric actuator 25 comprises a reversable electric motor 26 which is positioned below the supporting plate 24, a circular rotating plate 29 which is pivotally connected through a horizontal shaft 28 to a middle portion of the supporting plate 24 and operatively engaged with the motor 26 through a speed reduction gear 27 and a sectoral output member 30 which is secured to a peripheral portion of the rotating plate 29.

Designated by numeral 31 is a bearing plate which has both ends connected to inboard face of the supporting plate 24. The bearing plate 31 has a middle portion which bears one end of the shaft 28.

The rotating plate 29 is formed at its lower half peripheral portion with a plurality of teeth 29*a* to which a pinion 35 supported on the supporting plate 24 is operatively engaged. Due to normal or reversed rotation of the pinion 35, the rotating plate 29 is turned by about 90 degrees from its neutral angular position as shown in FIG. 3 in clockwise or counterclockwise direction.

The pinion 35 is connected to an output shaft 34 of the speed reduction gear 27, so that the pinion 35 is driven by the electric motor 26.

At an upper peripheral edge of the rotating plate 29, there is formed a recess 36. When the rotating plate 26 is in the neutral position, a sensor arm (no numeral) of a neutral position detecting switch "SW6" (microswitch) is placed at the recess 36, as shown in FIG. 3, thereby sensing the rotating plate 29 being in the neutral position.

The shaft 28 carries thereon, at the position between the rotating plate 29 and the bearing plate 31, two pivotal arms 37 and 38. To respective leading ends of these arms 37 and 38, there are connected respective rods 39 and 40.

When the rotating plate 29 is rotated from the neutral position in a counterclockwise direction in FIG. 3, an end of the output member 30 is brought into engagement with an engaging portion 37*a* formed on the arm 37 thereby to turn the arm 37 in the same direction and thus pull the rod 39 toward the rotating plate 29. While, when the rotating plate 29 is rotated from the neutral position in a clockwise direction in FIG. 3, the other end of the output member 30 is brought into engagement with an engaging portion 38*a* formed on the other arm 38 thereby to turn the arm 38 in the same direction and thus pull the rod 40 toward the rotating plate 29.

The arm 38 has an enlarged portion 38*b* integral thereto. The enlarged portion 38*b* is formed with two parallel arcuate slots 52 and 53 which are coaxial with the shaft 28.

To the slot 52, there is slidably engaged a slider 54 which is connected to the afore-mentioned inside handle 4 through a cable 57 which is received in a guide tube 56.

To the other slot 53, there is slidably engaged an extra slider 55 which is adapted to connect with an extra actuator device (not shown).

To an outboard surface of the case 12, there is secured a side plate 41. As is seen in FIG. 3, a generally L-shaped link 42 is pivotally connected to an upper portion of the side plate 41 through a shaft 43.

To a lower end of the link 42, there is pivotally connected the afore-mentioned rod 39. The link 42 is formed at its upper portion with an engaging portion 42*a* which is operatively engageable with the engaging portion 19*a* of the afore-mentioned rotating plate 19. That is, upon the rod 39 being pulled toward the circular rotating plate 29, the engaging portion 42*a* of the link 42 is brought into engagement with the engaging portion 19*a* of the rotating plate 19 and pushes down the same. With this, the latch 14 is forcedly pivoted from the half-latch position to the full-latch position.

Designated by numeral 44 is a spring for returning the link 42, and designated by numeral 45 is a stopper for holding the link 42 at a position remote from the traveling path of the rotating plate 19. The stopper 45 is provided by bending an upper end portion of the side plate 41.

Thus, the electric motor 26, the circular rotating plate 29, the output member 30, the arm 37, the rod 39 and the link 42 constitute the "latch driving device (B-2)" which forcedly drives the latch 14 from the half-latch position to the full-latch position.

As is shown in FIG. 3, to a lower portion of the side plate 41, there is pivotally connected another link 47 through a shaft 48. The link 47 has an upwardly extending arm portion 47*a* and a rightwardly extending arm portion 47*b*, and thus the link 47 is L-shaped.

To the upper end of the arm portion 47*a*, there is pivotally connected the afore-mentioned rod 40, and to the leading end of the other arm portion 47*b* there is pivotally connected a lower end of a push rod 49 through a shaft 50.

An upper part of the push rod 49 is slidably held by a suitable guide member (not shown), so that the push rod 49 is movable upward and downward along a given way. The push rod 49 has an upper end engageable with the arm portion 20*a* of the open lever 20.

Thus, upon the rod 40 being pulled toward the circular rotating plate 29, the link 47 is turned in a counterclokwise direction in FIG. 3 thereby pushing the push rod 49 upward. With this, the upper end of the push rod 49 pushes the arm portion 20*a* of the open lever 20 upward, so that the afore-mentioned pawl 16 is pivoted to its disengaging position, that is, the position wherein the pawl 16 releases the latch 14.

Designated by numeral 51 is a spring for returning the link 47.

Thus, the electric motor 26, the circular rotating plate 29, the output member 30, the arm 38, the rod 40, the link 47 and the push rod 49 constitute the "full closing lock cancelling device (B-1)" which turns the pawl 16 to its disengaging position.

The door driving device "C" comprises a supporting plate 60 securedly mounted in a front part of the door 2, a reversable electric motor 61 held by the supporting plate 60, a pinion 62 pivotally connected to the supporting plate 60 and driven by the motor 61 through a suitable speed reduction gear, a sector gear 64 and a horizontal push rod 69. The sector gear 64 has a front portion pivotally connected through a shaft 63 to a front upper part of the supporting plate 60 and an arcuate rear portion formed with teeth 64*a*. The teeth 64*a* extend along a part of a circle which has a center at the shaft 63. The teeth 64*a* are meshed with the pinion 62, so that upon normal or reversed rotation of the pinion 62, the sector gear 64 is pivoted about the shaft 63 between two positions which are defined by two spaced stoppers 65 and 66 formed on the supporting plate 60. The push rod 69 has a front portion piercing a front end wall of the door 2. The projected front end of the push rod is pivotally connected through a vertical shaft 67 to the vehicle body 1 at a position near one of hinges (not shown). The push rod 69 is formed at its rear portion with an elongate opening 68 into which a push piece 64*b* formed on the sector gear 64 is projected.

The push rod 69 is held by a holding device 70 mounted at the front end wall of the door 2. The holding device 70 comprises upper and lower press bodies 71 and 72 by which the push rod 69 is slidably sandwiched. Beside the major function of the push rod 69 as will be described hereinafter, the combination of the push rod 69 and the holding device 70 serves as a so-called "check device" which produce a suitable resistance against the opening and closing movement of the door 2.

Designated by numeral 73 is a cover which covers meshed portions between the pinion 62 and the sector gear 64. Designated by reference "SW7" is an inoperative position detecting switch for the sector gear 64, which becomes "on" when the sector gear 64 assumes its inoperative position with its lower part contacting the stopper 66. That is, under this condition, a front edge of a projection 64*c* formed on a lower middle part of the sector gear 64 is in contact with a sensor arm of the switch "SW7" causing the "on" condition of the switch. Designated by reference "SW8" is an operative position detecting switch which becomes "on" when the sector gear 64 assumes its operative position with its upper part contacting the stopper 65. That is, under this condition, a lower edge of the projection 64*c* is in contact with a sensor arm of the switch "SW8".

The door 2 has at a suitable portion thereof a door opening degree detecting switch "SW9" which becomes "on" when the door 2 is placed within an angular zone ranging from its fully closed position to a position which is somewhat outer as compared with the above-mentioned half-open position of the door 2. Under the "on" condition of the switch "SW9", a sensor arm of the switch is in contact with the vehicle body 1.

Thus, in the door driving device "C" as described hereinabove, when, due to "on" operation of the latch cancelling detecting switch "SW5", a latch cancelling of the full closing lock device "A" is detected, the motor 61 is operated causing the sector gear 64 to pivot in a counterclockwise direction in FIG. 1. With this, the push piece 64*b* is brought into contact with the front end of the elongate opening 68 causing the push rod 69 to project outwardly from the door 2. Thus, the door 2 is forced to pivot from the fully closed position to the half-open position with respect to the vehicle body 1.

When the door 2 reaches the half-open position, the same is restrained by the half opening lock device "D". When, the door 2 is further opened but slightly from the half-open position cancelling the restraining by the device "D", the door opening degree detecting switch "SW9" becomes inoperative thereby causing the motor to rotate in a reversed direction. Thus, the sector gear 64 is returned from the operative position to the inoperative position.

Accordingly, while the door 2 is kept at the half-open position, the sector gear 64 is kept at the operative position suppressing the push rod 69 from penetrating into the door 2. Thus, under this condition, the door 2 is not pivoted to the fully closed position. That is, it never occurs that, upon cancelling of the locked condition of the half opening lock device "D", the door 2 is closed suddenly. This is very advantageous because the possibility of injuring an operator's hand by accidentally putting the same between the door 2 and the vehicle body 1 becomes low.

Once the sector gear 64 has returned to the inoperative position, the opening and closing movement of the door 2 induces only an air-striking of the push piece 64*b* in the elongate opening 68, so that the movement of the door 2 is not interrupted by the half opening lock device "D".

Figure 8:
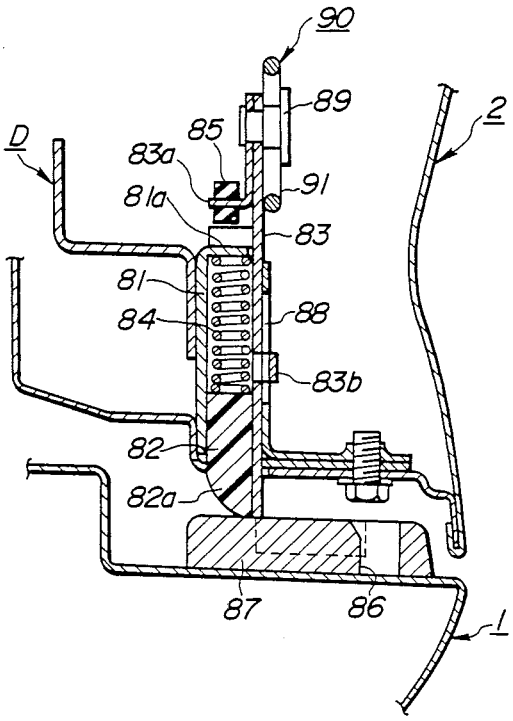
FIG. 8 is an enlarged sectional front view of a half opening lock device, showing a condition wherein a door is fully closed.
Figure 9:
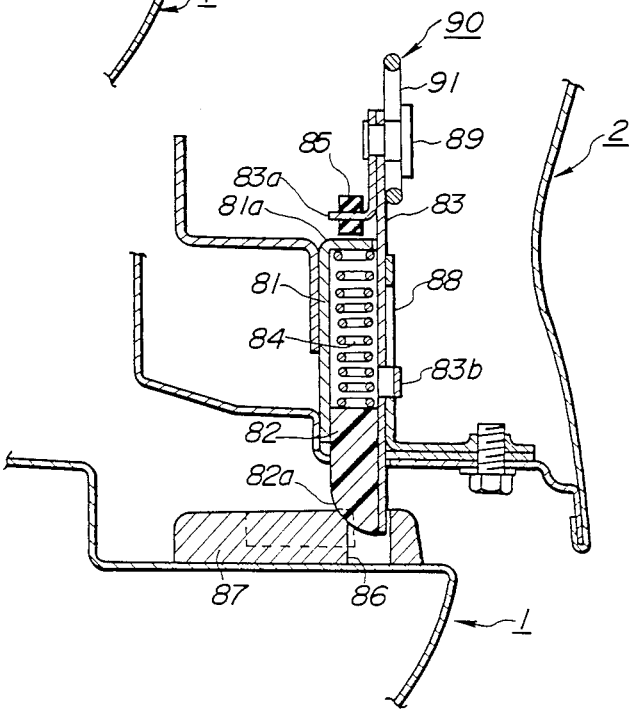
FIG. 9 is a view similar to FIG. 8, but showing an operative co wherein the door is opened to a slight open position and locked.

As is seen from FIGS. 1, 8 and 9, the half opening lock device "D" comprises a case 81 which is secured to a lower end portion of the door 2 having its lower open side exposed to the outside. A latching rod 82 is vertically slidably received in the case 81 with its tapered lower end 82*a* projectable into the outside. For the reason which will be clarified hereinafter, the tapered surface (82*a*) of the latching rod 82 is formed at the side which faces the interior of the vehicle body 1 when the door 2 is closed. A sliding plate 8 is secured to the latching rod 82 to move therewith and extends upward beyond the case 81. A spring 84 is received in the case 81 and compressed between an upper wall 81*a* of the case 81 and an upper end of the latching rod 82 thereby to bias the latching rod 82 downward with respect to the case 81, that is, with respect to the door 2. The sliding plate 83 has at a portion above the case 81 a holding bracket 83*a* secured thereto. A rubber piece 85 is connected to the holding bracket 83*a* to constitute a stopper. That is, during the downward movement of the sliding plate 83, the stopper 85 is brought into abutment with the upper wall 81*a* of the case 81 thereby to restrict the downward movement of the latching rod 82. An engaging plate 87 is secured to a lower peripheral wall of a door opening defined by the vehicle body 1. The engaging plate 87 has at a predetermined position an engaging bore 86 into which the above-mentioned tapered lower end 82*a* of the latching rod 82 is insertable when the door 2 comes to the half-open position.

The case 81 is formed at its outside wall with a vertically extending slot 88 with which a projection 83*b* formed on the sliding plate 83 is slidably engaged. Thus, the upward and downward movement of the latching rod 82 and the sliding plate 83 is smoothly guided.

As is seen from the drawings, the upper peripheral edges of the engaging plate 87 are chamfered. An inboard upper edge of the engaging bore 86 is somewhat tapered.

When, with the above-mentioned construction of the half opening lock device "D", the door 2 is in the fully closed position, the tapered lower end 82*a* of the latching rod 82 rides on the upper flat surface of the engaging plate 87, in such a manner as is illustrated in FIG. 8. When thereafter the door 2 is opened to the half-open position, the latching rod 82 is thrusted into the engaging bore 86 of the engaging plate 87 due to the force of the spring 84, in such a manner as is illustrated in FIG. 9. Under this condition, the opening movement of the door 2 is assuredly suppressed. However, due to the slidable engagement between the tapered surface 82*a* of the latching rod 82 and the tapered upper edge of the engaging bore 86, further closing movement of the door 2 is permitted but with a slight resistance produced by them.

Due to operation of the half opening lock cancelling device "E" which will be described in detail hereinafter, the latching rod 82 is raised against the force of the spring 84 to such a position that the tapered lower end 82*a* of the rod 82 is disengaged from the engaging bore 86. Under this condition, the door 2 can move or pivot freely.

When the door 2 is pivoted from a largely open position to the fully closed position, the following steps are taken by the half opening lock device "D".

First, the tapered lower end 82*a* of the latching rod 82 is brought into abutment with the chamfered outside edge of the engaging plate 87 and pushed upward by the same against the spring 84 to ride on the engaging plate 87. Then, during the closing movement of the door 2, the tapered lower end 82*a* falls into the engaging bore 86 and after sliding on the tapered upper edge of the bore 86, the same is raised up onto the engaging plate 87 as is shown in FIG. 8. It is to be noted that when the door 2 assumes the fully closed position, the tapered lower end 82*a* of the latching rod 82 is kept raised on the engaging plate 87.

The sliding plate 83 has at its upper end a connecting pin 89 secured thereto.

As will be seen from FIG. 1, the pin 89 is slidably received in an elongate slot 91 which is defined by a turned-up lower portion of a vertically extending rod 90.

An upper end of the rod 90 is pivotally connected to a lower end of an obliquely extending rod 94 through a pivotal lever 93 which is connected to the door 2 through a shaft 92. An upper end of the rod 94 is pivotally connected to a horizontally extending rod 97 through a pivotal lever 96 which is connected to the door 2 through a shaft 95.

The pivotal lever 96 is formed with an arcuate slot 98 which is concentric with the shaft 95. A pin 99 fixed to a front end of the horizontally extending rod 97 is slidably engaged with the arcuate slot 98, so that the obliquely extending rod 94 and the horizontally extending rod 97 have a relative play therebetween.

Figure 10:
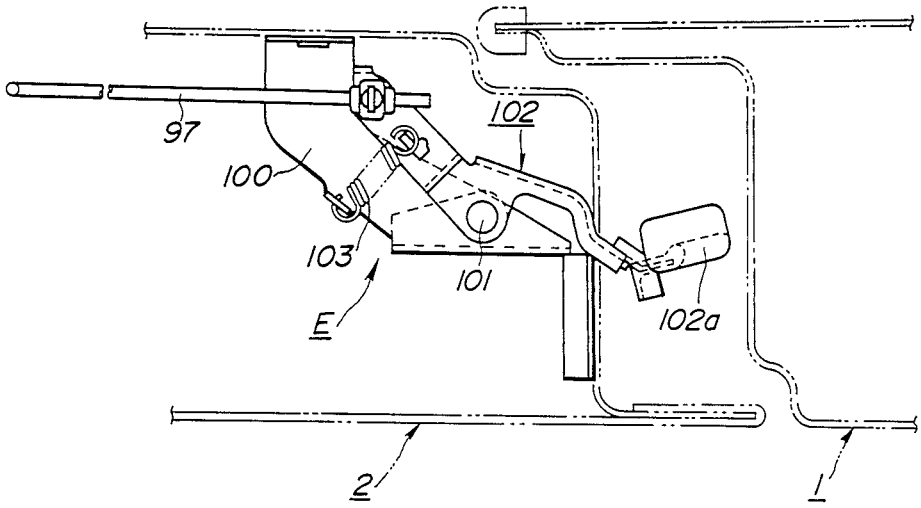
FIG. 10 is an enlarged horizontally sectional view of a rear end portion of the door in its fully closed condition.
Figure 11:
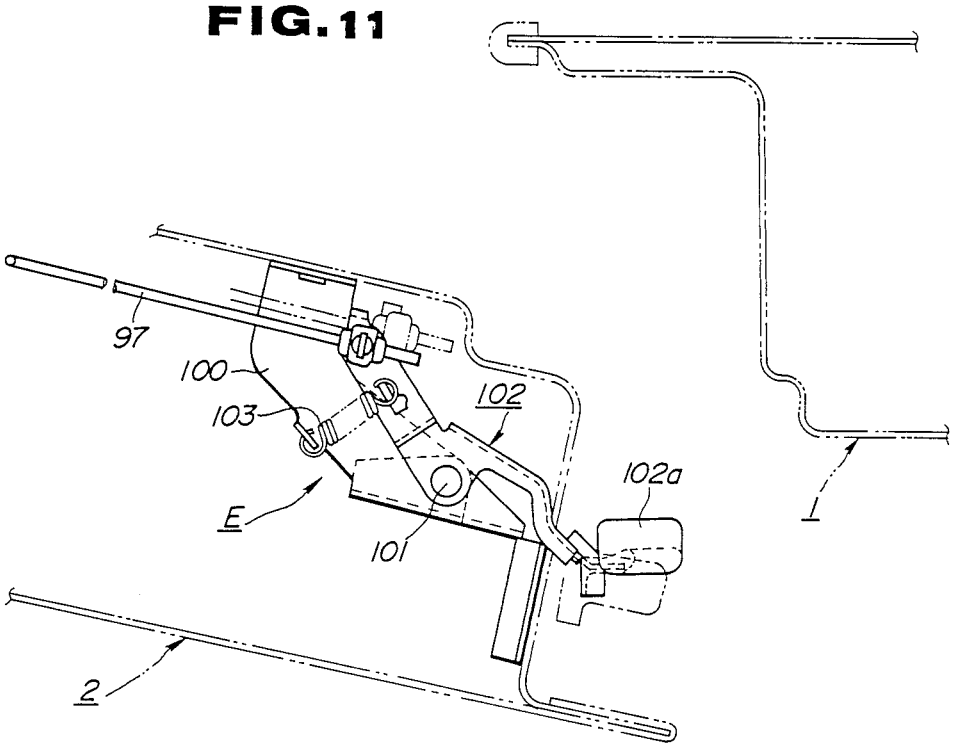
FIG. 11 is a view similar to FIG. 10, but showing a condition wherein the door assumes the slight open position.

As is best shown in FIGS. 10 and 11, a rear end of the horizontally extending rod 97 is connected to a front end of an operation handle 102. The operation handle 102 is pivotally connected through a vertically extending shaft 101 to a bracket 100 which is secured to a rear end portion of the door 2.

The operation handle 102 has at its rear part a grip part 102*a* which is projected outward from the rear end wall of the door 2. As is understood from FIG. 10, when the door 2 is in the fully closed position, the projected rear part of the operation handle 102 is fully concealed by the door 2 and the vehicle body 1. While, as is understood from FIG. 11, when the door 2 assumes the half-open position or much larger open position, the grip part 102*a* is exposed to the outside and thus manipulatable from the outside.

Designated by numeral 103 is a biasing spring which extends between the bracket 100 and the front portion of the operation handle 102 to bias the operation handle 102 in a counterclockwise direction in FIGS. 10 and 11.

Thus, the operation handle 102, the spring 103, and the rods 97, 94 and 90 constitute the half opening lock cancelling device "E".

When the operation handle 102 is pivoted in a clockwise direction in FIG. 11, the same pulls the rods 97, 94 and 90 in relays and thus pulls up the latching rod 82 from the engaging bore 86 of the engaging plate 87. With this operation, the locked condition by the half opening lock device "D" can be cancelled.

When the operation handle 102 is released from an operator's hand, the handle 102 is pivoted in a counterclockwise direction in FIG. 11 by the force of the spring 103 returning the rods 97, 94 and 90 and the latching rod 82 to their original positions.

As is shown in FIG. 1, to the shaft 95 to which the pivotal lever 96 is pivotally connected, there is further connected a triangular lever 104. One of the two lower apexes of the triangular lever 104 is connected to a part of the afore-mentioned inside handle 4 through a connecting rod 105.

To the other apex of the triangular lever 104, there is connected a terminal end of the afore-mentioned 57 which is slidably received in the guide tube 56.

The pivotal lever 96 has a downward extension 96*a* which has at its left side a raised section 96*b* against which a front edge of the triangular lever 104 abuts. Thus, when the triangular lever 104 is pivoted in a clockwise direction in FIG. 1, the same pushes the raised section 96*b* and thus pivots the pivotal lever 96 in the same direction about the pivot shaft 95. During this clockwise pivoting of the lever 96, the pin 99 on the end of the horizontally extending rod 97 slides in the arcuate slot 98 of the lever 96 without inducing movement of the rod 97.

When the rod 97 is pulled rearward pivoting the pivotal lever 96 in clockwise direction in FIG. 1, the raised section 96*b* of the lever 96 is separated from the front edge of he triangular lever 104. Thus, the triangular lever 104 does not move.

Designated by reference "SW10" in FIG. 1 is a lock cancelling switch which turns "on" when the inside handle 4 is turned, even slightly, from the illustrated rest position about the shaft 106 in a clockwise direction. Upon the switch "SW10" assuming "on" condition, the full closing lock cancelling device "B-1" is operated to cause cancelling of the locked condition of the full closing lock device "A".

Accordingly, when, with the door 2 being fully closed, it is intended to open the door 2 from the inside of the vehicle, the inside handle 4 is manipulated. That is, under the fully closed condition of the door 2, only a slight turning of the inside handle 4 is sufficient for turning the lock cancelling switch "SW10" "on" irrespective as to whether the locking and unlocking control device 5 assumes the unlock condition or the lock condition. Upon the switch "SW10" assuming the "on" condition, the locked condition of the full closing lock device "A" is automatically cancelled and then the door driving device "C" is operated causing the door 2 to open to the half-open position.

When, under this condition, the inside handle 4 is further turned, the movement of the inside handle is transmitted through the rod 105, the triangular lever 104, the pivotal lever 96, the rod 94, the pivotal lever 93 and the rod 90 to the half opening lock device "D" thereby to cancel the locked condition of the device "D".

Even when, due to for example malfunction of the motor 26, the full closing lock cancelling device "B-1" fails to operate, the locked condition of the full closing lock device "A" can be cancelled by manual labor. That is, even under such condition, the turning of the inside handle 4 induces a clockwise pivoting of the triangular lever 104 (as viewed in FIG. 1), so that the cable 57 is pulled toward the triangular lever 104 turning the arm 38 in a clockwise direction. With this, the locked condition of the full closing lock device "A" can be cancelled. This is a so-called "fail-safe" function.

Figure 12:
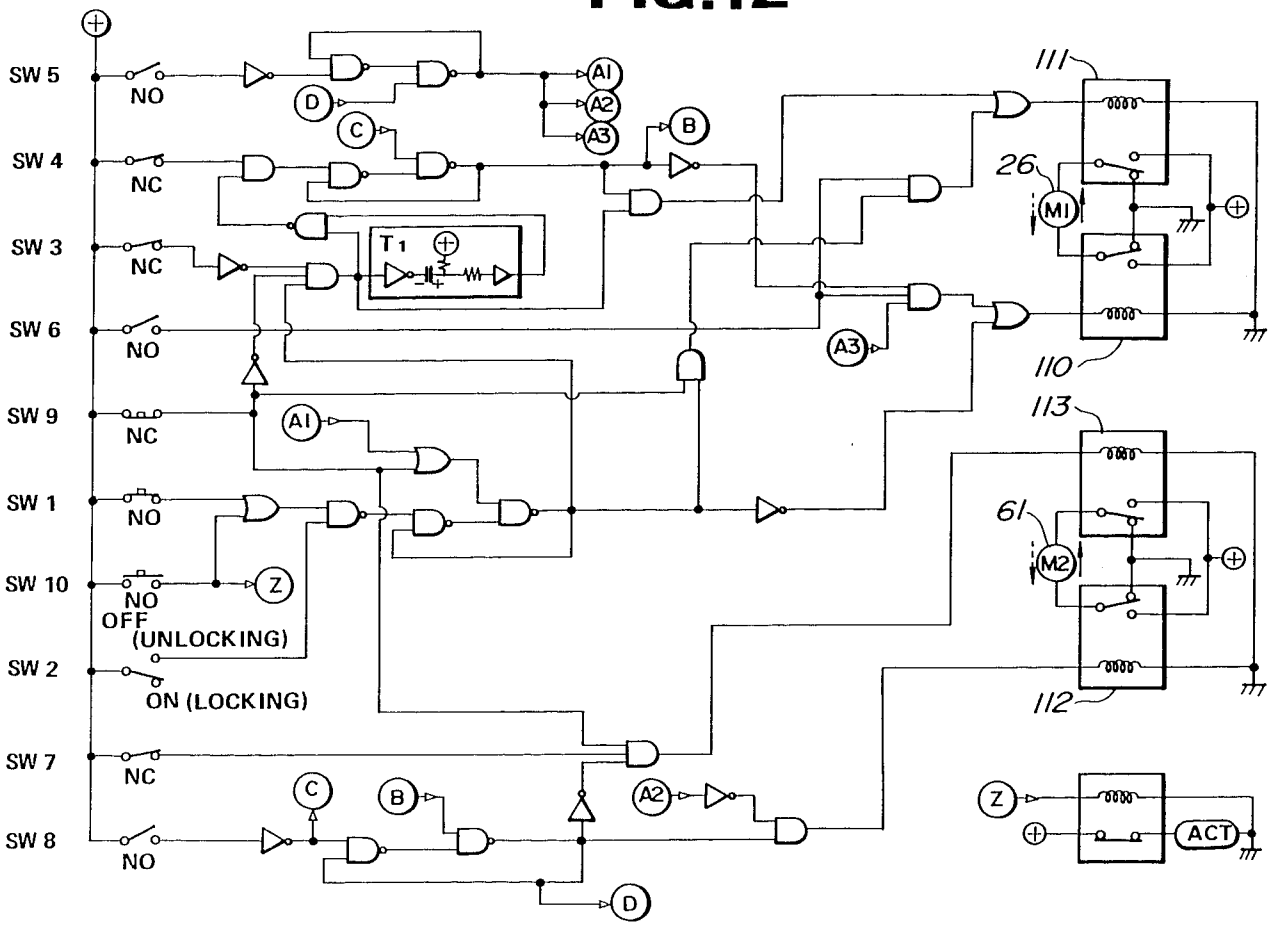
FIG. 12 is circuit diagram of a control device employed in the present invention.

FIG. 12 is a circuit diagram for controlling the electric parts employed in the door control device of the invention. As is shown, the various switches are illustrated in the left part of the circuit, and a latch cancelling relay 110 and a closure relay 111 which are incorporated with the electric motor 26 of the lock cancelling and latch driving device "B" and a door half opening relay 112 and a return relay 113 which are incorporated with the other electric motor 61 of the door driving device "D" are illustrated in the right part of the circuit. The parts are connected through a logical circuit including "AND", "OR", "NAND" and "NOR" circuits in a manner as shown in the drawing. Designated by reference "T1" is a timer circuit, and denoted by references "Al", "A2", "A3", "B", "C", "D" and "Z" are junction portions.

Operation, of the door control device of the invention will be described with reference to the control circuit.

For ease of understanding, the description will be commenced with respect to a condition wherein the door 2 is fully closed and the locking and unlocking switch "SW2" is in "off" condition (viz., unlocking condition).

When, under this condition, the lock cancelling operation switch "SW1" is pushed to turn "on", the latch cancelling relay 110 is energized to apply the electric motor 26 with current in the direction indicated by the arrow illustrated by a solid line. With this, the full closing lock cancelling device "B-1" is operated and thus the locked condition of the full closing lock device "A" is cancelled.

With the cancellation of the device "A", the latch cancelling detecting switch "SW5" becomes "on" causing deenergization of the latch cancelling relay 110 and energization of the closure relay 111. Under this, the electric motor 26 is applied with current in the direction indicated by the arrow illustrated by the broken line causing the motor 26 to run in a reversed direction. Thus, the rotating plate 29 is returned to its neutral position inducing "on" condition of a neutral detecting switch "SW6". With this, the closure relay 111 is deenergized and thus energization of the electric motor 26 is stopped.

Upon the latch cancelling detecting switch "SW5" assuming "on" position, the door half opening relay 112 becomes energized thereby to apply the motor 61 with current in the direction indicated by the arrow illustrated by the solid line. With this, the door driving device "C" is operated and thus the door 2 is opened to the half-open position.

Upon this, the half opening lock device "D" is operated to restrain the door 2 at the half-open position.

When the sector gear 64 comes to the operative position, the operative position detecting switch "SW8" becomes "on" causing deenergization of the door half opening relay 112. Thus, the motor 61 stops.

When, by operating the half opening lock canceling device "E", the locked condition of the half opening lock device "D" is cancelled and thereafter the door 2 is somewhat opened further, the operation of the door opening degree detecting switch "SW9" stops causing energization of the return relay 113. With this, the motor 61 is applied with current in the direction indicated by the arrow illustrated by the broken line and thus the motor 61 runs in a reversed direction. Thus, the sector gear 64 is returned to the inoperative position.

Upon this, the inoperative position detecting switch "SW7" becomes operative causing deenergization of the return relay 113. Thus, the motor 61 stops.

Operation taken when the door 2 is being closed will be briefly described in the following.

During the time for which the door 2 is manually pivoted from a relatively large open position to the half-latch positon beyond the half-open position, that is, to the position wherein the latch 14 of the full closing lock device "A" halfly catches the striker 13 of the door 2, the downwardly projected tapered lower end 82*a* of the latching rod 82 is brought into abutment with the chamfered outside edge of the engaging plate 87 and pushed upwardly by the same against the spring 84 and thus forced to ride on the engaging plate 87, and then the tapered lower end 82*a* falls into the engaging bore 86 and after sliding on the tapered upper edge of eh bore 86, the same is forced to ride on the engaging plate 87 again. Operation of the door opening degree detecting switch "SW9" taken during this movement has no effect on the motors 26 and 61.

When the door 2 comes to the half-latch position, the half latch detecting switch "SW3" becomes "on" thereby applying through the closure relay 111 the electric motor 26 with current in the direction indicated by the arrow illustrated by the broken line in the drawing. With this, the circular rotating plate 29 is rotated in a clockwise direction in FIG. 1 causing the latch driving device "B-2" to operate.

Due to operation of the device "B-2", the door 2 is forcedly closed from the half-latch position to the fully closed position.

When the door 2 comes to the fully closed position and thus the latch 14 comes to the full-latch position, the full-latch detecting switch "SW4" becomes "on" causing deenergization of the closure relay 111 and energization of the latch cancelling relay 110. With this, the electric motor 26 is applied with current in the direction indicated by the arrow illustrated by the solid line. Thus, the circular rotating plate 29 is rotated in a counterclockwise direction in FIG. 1 to its neutral position. Upon this, the neutral position detecting switch "SW6" becomes "on", so that the motor 26 is stopped and thus the door control. device assumes its original position taken when the door 2 is fully closed.

What is claimed is:

1. A door control device for controlling the movement of a door relative to a vehicle body, said door control device comprising:

a full closing lock device mounted to the door and latchingly restraining said door to said vehicle body when said door is pivoted to its fully closed position;

a lock cancelling operation switch mounted on said door at a position to be manipulatable from the outside of the vehicle body;

a full closing lock cancelling device mounted on said door and cancelling a locked condition of said full closing lock device upon operation of said lock cancelling operation switch;

a door driving device arranged between said door and said vehicle body, said door driving device driving said door to a predetermined half-open position upon cancellation of the locked condition of said full closing lock device;

a half opening lock device mounted on said door and latchingly restraining said door to said vehicle body when said door is pivoted to said half-open position; and a half opening lock cancelling device mounted on said door for cancelling a locked condition of said half opening lock device.

2. A door control device as claimed in claim 1, in which said door driving device comprises:

an electric motor mounted on said door;

a sector gear pivotally mounted on said door and pivotally driven by said electric motor; and a push rod having one end portion pivotally connected to said vehicle body and the other end portion engageable with a portion of said sector gear.

3. A door control device as claimed in claim 2, in which said sector gear is integrally formed with a push piece and said push rod is formed at the other end portion thereof with an elongate opening, said push piece being projected into said elongate opening.

4. A door control device as claimed in claim 3, in which said door driving device further comprises a speed reduction gear which is arranged between said electric motor and said sector gear for reducing the speed of movement of said sector gear as compared with that of the electric motor.

5. A door control device as claimed in claim 4, in which said electric motor is of a reversable type.

6. A door control device as claimed in claim 5, in which said push rod is axially movably held by a holding device which is mounted on said door.

7. A door control device as claimed in claim 1, in which said door driving device comprises a biasing spring which extends between said door and said vehicle body to bias said body to open relative to said vehicle body.

8. A door control device as claimed in claim 1, in which said half opening lock cancelling device is mounted to an edge portion of said door, said edge portion being fully concealed by said door and said vehicle body when said door assumes its fully closed position, but exposed to the outside of said vehicle body when said door assumes the half-open position.

9. A door control device as claimed in claim 8, in which said half opening lock cancelling device comprises an operation handle which is pivotally connected to said edge portion of said door and a plurality of linked rods through which said operation handle is connected to said half opening lock device, said operation handle having a grip portion which is projected outward from said edge portion of said door to be manipulatable from the outside.

10. A door control device as claimed in claim 9, in which said half opening lock cancelling device further comprises a control switch mounted to said door and an electric actuator mounted to said door, said actuator cancelling the locked condition of said half opening lock device upon manipulation of said control switch.

11. A door control device as claimed in claim 10, in which said half opening lock device comprises:

a latching rod slidably held by said door, said latching rod having a tapered end which is projectable into the outside;

a spring incorporated with said latching rod to bias said latching rod outwardly; and an engaging plate secured to said vehicle body, said engaging plate having an engaging bore into which said tapered end of said latching rod is insertable to achieve latching of said door relative to said vehicle body.

* * * * *